United States Patent [19]

Kobayashi et al.

[11] Patent Number: 4,666,320

[45] Date of Patent: May 19, 1987

[54] INK RIBBON FOR SUBLIMATION TRANSFER TYPE HARD COPY

[75] Inventors: Naotake Kobayashi; Tetsuya Abe; Shinohara Satoru; Yoshio Fujiwara, all of Kanuma, Japan

[73] Assignee: Sony Corporation, Tokyo, Japan

[21] Appl. No.: 749,624

[22] PCT Filed: Oct. 15, 1984

[86] PCT No.: PCT/JP84/00488

§ 371 Date: Jun. 17, 1985

§ 102(e) Date: Jun. 17, 1985

[87] PCT Pub. No.: WO85/01698

PCT Pub. Date: Apr. 25, 1985

[30] Foreign Application Priority Data

Oct. 15, 1983 [JP] Japan ..... 58-192959
Apr. 24, 1984 [JP] Japan ..... 59-82251

[51] Int. Cl.[4] ..... B41J 31/05

[52] U.S. Cl. ..... 400/241.1; 346/76 PH; 400/120

[58] Field of Search ..... 400/120, 241.1, 241, 400/241.2, 241.4; 346/76 PH; 101/336

[56] References Cited

U.S. PATENT DOCUMENTS 4,269,892 5/1981 Shattuck ..... 400/241.1 X
4,309,117 1/1982 Chang ..... 400/241.1
4,427,985 1/1984 Kikuchi ..... 346/76 PH X
4,453,839 6/1984 Findlay ..... 400/241.1 X
4,459,055 7/1984 Asakura ..... 400/241.1 X
4,461,586 7/1984 Kawanishi ..... 400/120
4,465,389 8/1984 Knirsch ..... 400/241.1
4,527,171 7/1985 Takanashi ..... 346/76 PH
4,572,684 2/1986 Sato ..... 400/120 X

FOREIGN PATENT DOCUMENTS 105994 8/1981 Japan ..... 400/120
43889 3/1982 Japan ..... 400/120
201686 12/1982 Japan ..... 400/120
138685 8/1983 Japan ..... 400/120

*Primary Examiner*—Paul T. Sewell
*Attorney, Agent, or Firm*—Hill, Van Santen, Steadman & Simpson

[57] ABSTRACT

The present invention relates to an ink ribbon for sublimation transfer type hard copy which is used to produce as a hard copy a still picture image such as a picture image taken by a video camera, a television picture image and so on. The ink ribbon for sublimation transfer type hard copy of this invention comprises a heat-resistant plastic film base or a plastic film base having formed thereon a heat-resistant treating layer and coating layer of sublimation dye formed on the plastic film base. According to this ink ribbon for sublimation transfer type hard copy, it is possible to protect the film base from being shrunk and producing a bubble spot therein due to heat generated upon transfer, etc. Accordingly, a quality of a transferred picture image can be improved.

10 Claims, 12 Drawing Figures

INK RIBBON FOR SUBLIMATION TRANSFER TYPE HARD COPY

DESCRIPTION

1. Technical Field

The present invention relates to an ink ribbon for a sublimation transfer type hard copy used to produce a hard copy of a still picture image such as a picture image taken by a video camera, a television picture image and so on.

2. Background Art

FIG. 1 shows an example of a prior art printer for a sublimation transfer type hard copy. This printer comprises a platen 2 having wound therearound a printing paper 1 and which is rotatable in the direction shown by an arrow a and a thermal print head 4 which is urged against the platen across an ink ribbon 3 for use in thermal transfer recording. On the point of the thermal print head 4, there are arranged heat generating elements 4*a* whose total number corresponds to the number of picture elements in one scanning line of, for example, a television picture image.

The ink ribbon 3 for use in thermal transfer recording tightly pressed between the thermal print head 4 and the printing paper 1 is formed of a film base 9 on which, for example, an yellow ink layer Y, a magenta ink layer M, a cyan ink layer C and a black ink layer B each having a configuration corresponding to a configuration of a picture screen of a television picture image are repeatedly arranged in turn. Further, ink portion position detecting marks 5Y, 5M, 5C and 5B are respectively formed on one side edge of the film base at the positions of the corresponding color ink portions so as to detect the positions of the ink portions and a block position detecting mark 6 is formed on the other side edge of the film base so as to detect each combination group of four colors of Y, M, C and B.

Under the condition that the yellow ink layer Y, for example, is urged against the printing paper 1 as described above, by an information corresponding to yellow, for example, a color signal corresponding to yellow of a television video signal, each head element 4*a* of the thermal print head 4 is heated with a pattern corresponding to the picture elements of one scanning line to thereby thermally transfer the yellow sublimation dye contained in the yellow ink layer Y to the printing paper 1 in accordance with the heated pattern. At every line corresponding to each scanning line, the platen 2 is intermittently rotated in the direction shown by the arrow a to thereby carry out the thermal transfer of information of each line. When the platen 2 is rotated one turn, the yellow color of one picture screen amount is transferred. Then, a similar transfer treatment is carried out with respect to the magenta color and subsequently, the cyan color and the black color are sequentially transferred repeatedly to thereby superpose the transferred picture images of the sublimation dyes of the yellow, magenta, cyan and black sublimation dyes one over another, thus a color picture image being printed on the printing paper. In this case, detecting means are provided to detect the marks 5 (5Y, 5M, 5C and 5B) and 6 in the ink layers Y, M, C and B of respective colors for the purpose of supplying the signals corresponding to the respective color signals to the head elements 4*a* of the thermal print head 4. This detecting means includes, for example, a light source 7 for emitting a light ray for use in detection, for example, an infrared ray emitting diode and a detecting element 8 for detecting the infrared ray in which case, both of them are disposed in opposing relation to each other at both sides of the ink ribbon 3 for use in thermal transfer recording at which the marks 5 and 6 are provided. In the detecting means, the detecting element 8 produces a detected signal dependent on the presence or absence of the marks 5 and 6 whereby to detect the positional relation of the ink ribbon 3 for use in thermal transfer recording relative to the thermal print head 4.

As the ink ribbon for such sublimation transfer type hard copy, there is used in the art one formed on a film base 9 made of a paper such as a condenser paper, which is thin, uniform and dense, and a coating layer made of an ink in which a sublimation dye is dissolved and dispersed into a resin and solvent. As described above, since in the prior art ink ribbon, the paper is used as the film base 9, when the ink ribbon 3 is heated by the thermal print head 4, the water component contained in the paper is evaporated and the film base 9 is considerably shrunk to thereby produce wrinkles between the printing paper and the ink ribbon 3, thus lowering the picture quality. Although the amount of water component contained in the paper is very small, the water is boiled up momentarily by the thermal print head 4 heated around 400° C., producing a bubble spot in the film base 9. The fact that the heat is absorbed by the water upon boiling decreases sublimation amount of dye in the ink ribbon 3 and causes the bubble spot in the picture image to appear as a varying density spot, thus lowering the picture quality considerably.

On the surface of the printing paper 1 to which the sublimation dye is transferred, there is provided a protecting layer. This protecting layer is to avoid dye which has not diffused into the coating layer from causing defects in coloring and pollution of other materials. Further, since the dye coagulated on the coating composition layer can not produce the color inherent to the dye if the dye is left as it be, it is necessary that the coagulated dye is diffused sufficiently into the protecting layer to complete the coloring inherent to the dye. As a method for forming such protecting layer to achieve the above-described objects, the present applicant has previously proposed a method for forming a cover film by a laminator, a method for forming a protecting layer in which without using the laminator, the cover film layer formed on the ink ribbon is pressed by the same thermal print head so as to produce the protecting layer and so on. By virtue of such technique, the protecting layer can be formed on the printing paper 1 very easily. However, since the film base of the ink ribbon on which the cover film layer is formed is made of condenser paper similarly to the prior art, there are the following problems. When a resin layer which becomes the cover film layer is formed on the surface of the condenser paper, a releasing treatment must be carried out so as to prevent the resin layer and the condenser paper from being melt bonded. However, the dye coating layer must be bonded well to the condenser paper so that it is difficult to carry out the treatment selectively during manufacturing. Further, even if the releasing treatment is carried out, a smooth surface is difficult to obtain on the protecting layer because the condenser paper is not always flat.

In view of the above-described aspect, this invention is to provide an ink ribbon for sublimation transfer type hard copy which is free from shrinking of the film base, free from bubble spots formed in the film base and so on caused by heat generated upon transfer so that an excellent picture quality can be obtained.

DISCLOSURE OF INVENTION

This invention relates to an ink ribbon for sublimation transfer type hard copy, in which an ink layer of sublimation dye is formed on a heat-resistant plastic film base or a plastic film base having formed thereon a heat-resistant coating composition layer.

Further, this invention relates to an ink ribbon for sublimation transfer type hard copy in which under the condition that the ink ribbon carrying a sublimation dye and a printing paper are in contact with each other, a picture image is formed on the printing paper by a selective heating treatment, wherein the ink ribbon is formed by forming a coating layer of sublimation dye on a heat-resistant plastic film base or a plastic film base having formed thereon a heat-resistant coating composition layer.

According to such ink ribbon, it is possible to protect the film base from being shrunk and producing a bubble spot therein due to heat generated upon transfer, etc. Accordingly, a quality of a transferred picture image can be improved.

BEST MODE FOR CARRYING OUT THE INVENTION

Figure 2:
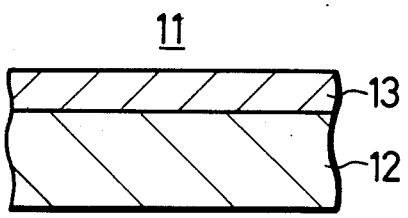
FIGS. 2 to 5 are respectively cross-sectional views showing embodiments of an ink ribbon according to the present invention.

In a first embodiment of the present invention, as shown in FIG. 2, as the film base, there is used a heat-resistant plastic film 12 having no melting point on which a sublimation dye coating layer 13 is formed to thereby make an ink ribbon 11. In this case, if the ink ribbon is an ink ribbon for use with a color picture image, on the base 12, there are repeatedly formed the coating layers 13 of yellow, magenta, cyan and black colors in turn, whereas if the ink ribbon is an ink ribbon for use with a black and white picture image, only a coating layer 13 of black color is formed on the base 12.

As the heat-resistant plastic which does not have a melting point, it is possible to use a plastic such as polyimide, polyamide, aromatic polybenzimidazole and so on which begin to be carbonized or decomposed before being melted by heat and a moisture proof cellophane.

Figure 3:
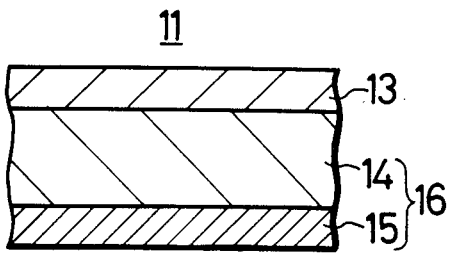

In a second embodiment of the present invention, as shown in FIG. 3, as the film base, there is used a plastic film base 16 in which a normal plastic film 14 is formed thereon with a heat-resistant treating layer 15 which does not have a melting point and on the surface of the plastic film on which the heat-resistant treating layer 15 is not formed, there is formed a sublimation dye coating layer 13 to thereby form an ink ribbon 11.

The normal plastic may be polyester, such as, polyethylene terephthalate, polyacrylate, polyethersulfone and so on which can not endure the heat generated from the thermal print head but has a relatively high heat-resistant property and which is also inexpensive. The heat-resistant treating layer 15 is made of a substance which does not have a melting point such as nitrocellulose and polyimide lacquer which begin to be carbonized or decomposed before being melted by heat or a heat curable heat-resistant resin such as melamine resin, aminoalkyd resin, epoxy resin, silicone denatured epoxy resin and so on or unsaturated polyester and unsaturated oligomers such as epoxy acrylate is mixed with a curing agent, coated and then cured. Alternatively, the heat-resistant treating layer may be made of coating layer containing a denatured silicone resin denatured by a resin such as alkyd resin, epoxy resin, acrylic resin or urethane resin and so on. Then, the denatured silicone resin is mixed with melamine resin or imidazole and the like, coated and then cured to thereby form the heat-resistant treating layer. The thickness of the treating layer 15 is not limited particularly but preferably selected in a range from 1 $\mu$m to 10 $\mu$m.

A coating material in which a heat-resistant powder is dispersed into the resin may be used to form the heat-resistant treating layer 15 of this ink ribbon 11. The heat-resistant powder may be inorganic powder such as silica, calcium carbonate, titanium oxide, carbon, graphite and so on, heat-resistant organic powder such as teflon, silicone, cellulose powder and so on.

As described above, since the heat-resistant treating layer 15 contains the heat-resistant powder, the friction coefficient between the ink ribbon 11 and the thermal print head can be lowered to thereby enable the ink ribbon to smoothly slide on the thermal print head.

Figure 5:
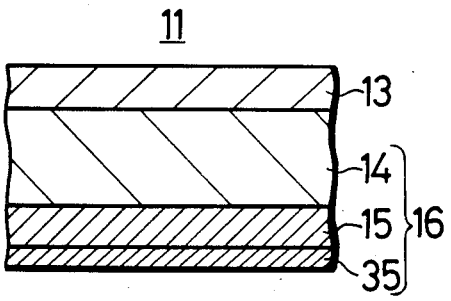

FIG. 5 shows a further embodiment of this invention in which a lubricant layer 35 is formed on the heat-resistant treating layer 15 of the ink ribbon shown in FIG. 3. This lubricant layer ensures that the ink ribbon can slide on the thermal print head smoothly. This lubricant layer can be formed by coating on the layer a releasing agent such as silicone resin and the like.

Figure 4:
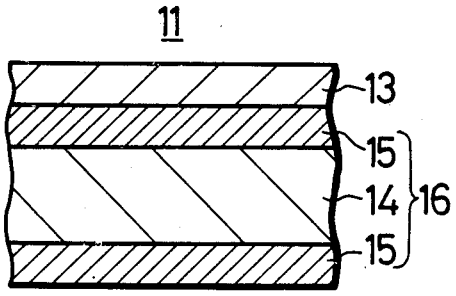

In a third embodiment of the present invention, as shown in FIG. 4, a plastic film base 16 in which the heat-resistant treating layers 15 are formed on the both surfaces of the ordinary plastic film 14 is used and the sublimation dye coating layer 13 is formed on the surface of one of the heat-resistant treating layers, thus the ink ribbon 11 being formed.

When the plastic material such as polyimide having a high heat-resistant property is selected to be the material of the film base as in the first embodiment, such plastic film can be used, as it is, as the plastic film base 16 of this invention. However, if the ink ribbon is formed as described above, the price thereof is increased generally. For this reason, as shown in the second and third embodiments, if the heat-resistant treating layer 15 is formed on the surface of the inexpensive plastic film of thermoplastic property such as a polyester film base which can not endure the heat generated from the thermal print head by itself and which is difficult to be used as the film base of the ink ribbon, it is possible to make the ink ribbon 11 of this invention having a sufficiently high heat-resistant property. Although the heat-resistant treating layer 15 is formed on the surface of the plastic film, if the ink ribbon is exposed in a high temperature of about 400° C. for a long time, the treating layer 15 and the plastic film 14 are both melted. However, the heating by the thermal print head lasts for a very short time of period ranging from several tens microseconds to several tens milliseconds so that the plastic film 14 is not melted and thus the heat-resistant property of the treating layer 15 can prevent the ink ribbon 11 from being melt bonded and deformed.

As described above, as the film base of the ink ribbon for sublimation transfer type hard copy, the heat-resistant plastic film base or the plastic film base having formed thereon the heat-resistant treating layer is used so that such film base contains no water component, thus the picture image becomes free of the bubble spot completely. Further, contrary to the condenser paper, the plastic film is swollen a little by the heating so that the ink ribbon in contact with the printing paper is not wrinkled. Accordingly, it is possible to increase the quality of the transferred picture image considerably.

Figure 6:
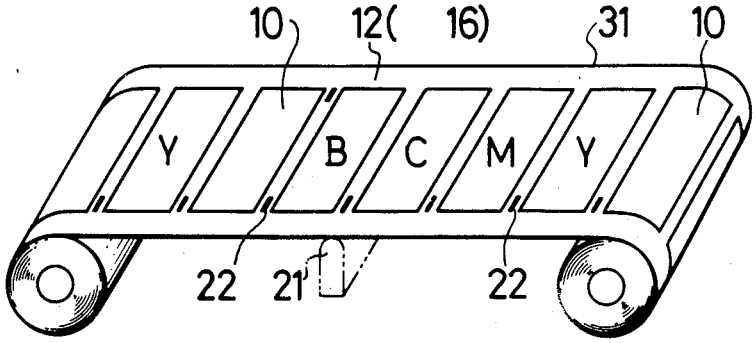
FIG. 6 is a perspective view of an ink ribbon for a color picture image.

FIG. 6 illustrates other embodiment of the present invention which utilizes the fundamental structure of the above-described present invention. Particularly in this case, the present invention is applied to an ink ribbon for a color picture image in which after the picture image is formed, the protecting layer can be formed successively.

In this embodiment, on one surface of the heat-resistant plastic film or the plastic film base 12 (or 16) on which the heat-resistant treating layer is formed, the coating layers 13 mainly made of the sublimation dye are formed sequentially as in the order of yellow Y, magenta M, cyan C and black B (this can be provided as required). Between the adjacent combinations of the ink layers 13 (Y, M, C and B) of 4 colors, there is formed a protecting layer or a cover film layer 10 to thereby form an ink ribbon 31 for a color picture image. This cover film layer 10 is made of a transparent resin layer which can not be bonded to the plastic film base 12 or 16 but can easily be melt bonded to the surface of the printing paper. The thickness of the cover film layer 10 is in a range from 1 to 10μ. The material of this cover film layer may be polyester resin, epoxy resin, cellulose acetate resin, nylon resin, polyvinylpyrrolidone resin and so on, each having a melt bonding property. As required, the releasing treatment can be carried out between the base film 12 or 16 and the cover film layer 10. The cover film layer 10 may contain an ultraviolet absorbent or phosphor whitener and so on, if necessary. Reference numeral 22 designates a sensor mark for use in determining the position.

Figure 1:
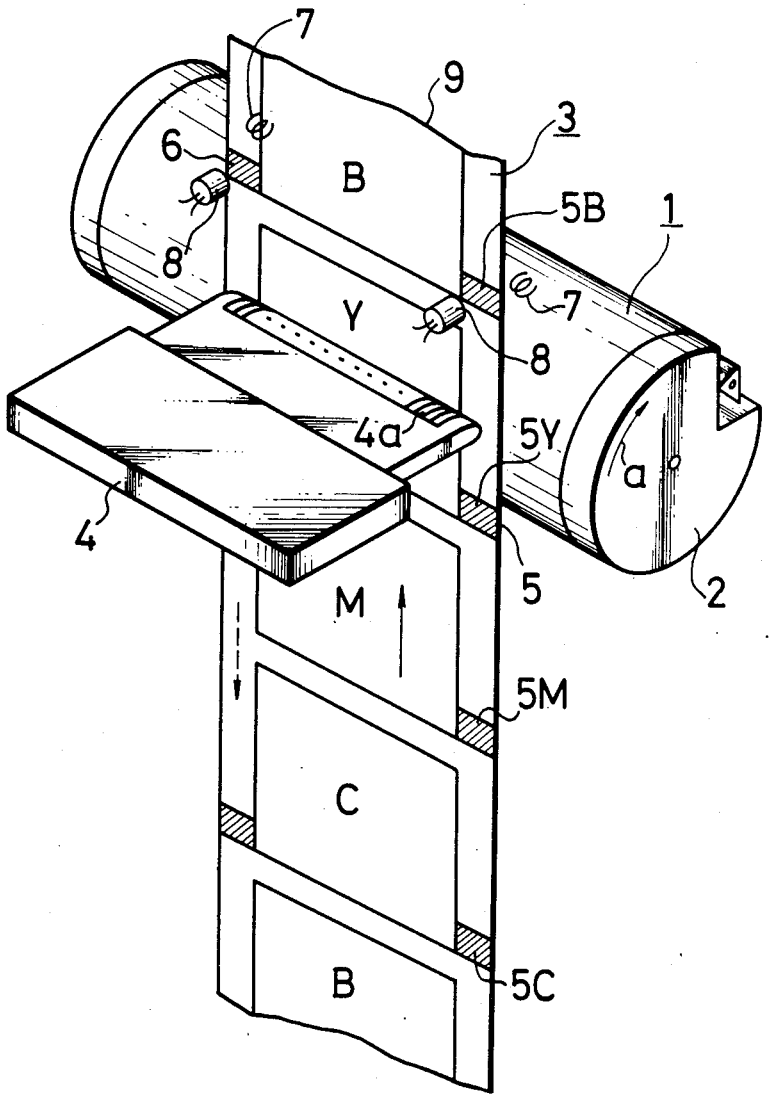
FIG. 1 (PRIOR ART)
FIG. 1 is a perspective view of a prior art printer for sublimation transfer type hard copy.
Figure 7:
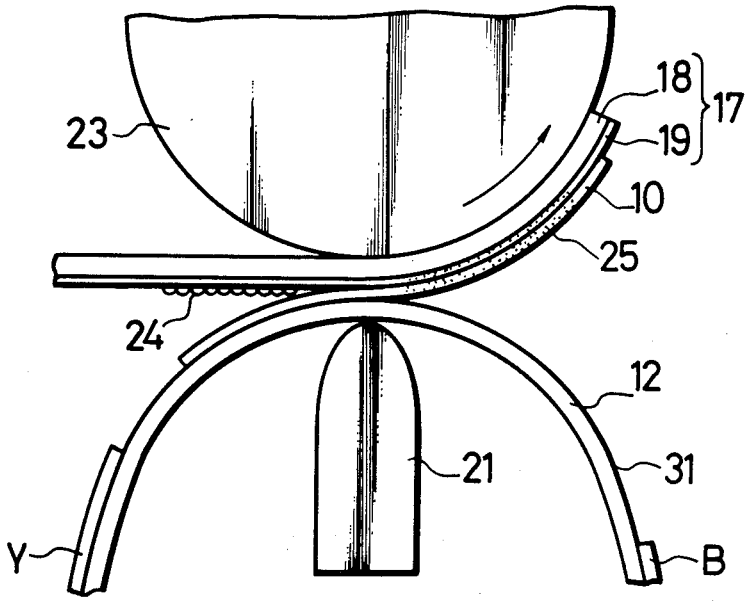
FIG. 7 is a side view showing the ink ribbon of the present invention while in use.

FIG. 7 illustrates a state of a transfer treatment which uses such ink ribbon 31. Reference numeral 17 designates a printing paper in which a dye diffusing layer 19 is formed on the surface of a base 18. Reference numeral 23 designates a platen which moves the printing paper 17 and reference numeral 21 designates a thermal print head which is provided at its point with heat generating elements whose number is corresponding to the number of the picture elements in one scanning line of the picture image. The ink ribbon 31 is tightly pressed against the printing paper 17 by the thermal print head 21. In this ink ribbon 31, in like manner described in connection with FIG. 1, each heat generating element of the thermal print head 21 is supplied with the electric power in accordance with the video signal so as to sequentially sublimate and transfer the dyes of yellow Y, magenta M, cyan C and black B in response to the heated amount, thus forming a color picture image on the printing paper 17. Thereafter, the ink ribbon 31 is heated at its portion of the cover film layer 10 by the thermal print head 21 to thereby melt bond the cover film layer 10 to the printing paper 17. When the cover film layer 10 is melt bonded to the printing paper, a dye coagulated material 24 of picture image transferred from the ink ribbon 31 is diffused into the cover film layer 10 and the dye diffusing layer 19 of the printing paper 17. Reference numeral 25 designates the dye that is diffused as mentioned above. As set forth above, at the same time when the color picture image is formed, the cover film layer is formed. According to such ink ribbon 31 for a color picture image, as the film base thereof, there is used the heat-resistant plastic film base 12 (or 16) so that the bubble spot caused by the evaporation of water component and the wrinkles will not appear and in addition, the protecting layer having the smooth surface can be formed. In the plastic film base 12 (or 16), if necessary, the releasing treatment may be carried out over the portion of the protecting layer and further, a primer treatment may be carried out over the portion in which each color coating layer is formed.

Practical examples of the ink ribbon 31 for a color picture image will be described next.

EXAMPLE 1

A treating liquid made of 24 parts by weight of internally plasticized saturated polyester resin (VYLON #200 manufactured by Toyobo Co., Ltd.), 6 parts by weight of super fine powder silica (NIPSIL E220A manufactured by Nippon Silica Industrial Co., Ltd.) and 70 parts by weight of methyl ethyl ketone solvent was coated on one surface of a best quality paper having an area weight of 170 g/m$^2$ so as to have a coated amount of about 5 g/m$^2$ after being dried, thus a printing paper for sublimation transfer type color hard copy being prepared. On the other hand, in addition to the ink of magenta color such as an ink made of 6 parts by weight of dispersion dye (PTR 63 manufactured by Mitsubishi Chemical Industries Co., Ltd.) of anthraquinone-system having a sublimation property, 6 parts by weight of ethylcellulose and 88 parts by weight of isopropyl alcohol solvent, like inks of cyan color, yellow color and black color were respectively provided. Then, on a polyimide film having a thickness ranging from 5 to 50 μm or 25 μm in this example, the inks of 4 colors were successively coated by a gravure coater so as to have a coated amount of 3 g/m$^2$ after being dried. Further, on the surface of the polyimide base having the thickness of 25 μm whose one surface is subjected to the releasing treatment between the adjacent groups of the ink portions of 4 colors, there was coated a resin liquid in which an ultraviolet absorbent (Tinuvin P manufactured by Ciba Geigy A.G.) was dissolved and mixed into a saturated polyester resin (VYLON #200 manufactured by Toyobo Co., Ltd.) which was internally plasticized with mixing ratio of 0.2 weight % relative to the resin so as to have a thickness of 10 μm after being dried to thereby form a cover film. Next, this ink ribbon was heated from the back thereof by the thermal print head heated at a temperature of about 300° C. to sequentially print the four colors on the above-described printing paper to thereby provide a color print and then the cover film layer was formed on the picture image. It was discovered that the picture image thus formed have no bubble spot due to the evaporation of water component and no displacement of the picture image.

Figure 8:
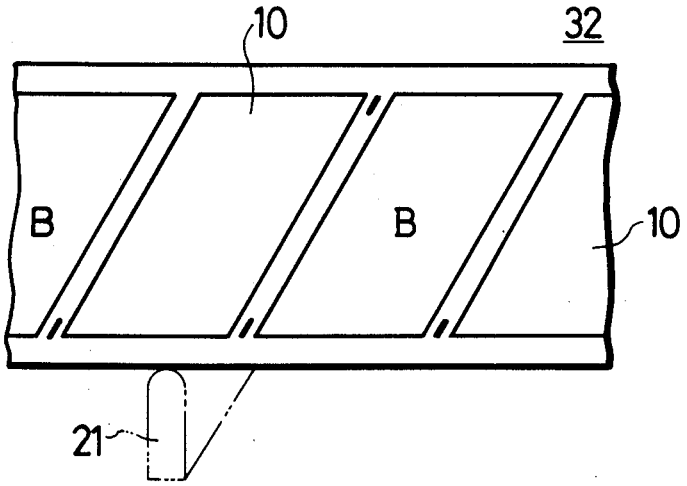
FIG. 8 is a perspective view of an ink ribbon for a black and white picture image.

An ink ribbon 32 for a black and white picture image is formed such that as shown in FIG. 8, the coating layer B of black color ink and the cover film layer 10 are sequentially formed.

EXAMPLE 2

A base material 14 was made by a polyester film having a thickness of 8 μm. On one surface of this base material 14, there was coated a resin liquid having the following composition by a pipe coater such that the heat-resistant treating layer 15 might have a thickness of 3 μm after being dried. Thereafter, at a temperature of 130° C., it was heated and then cured for an hour.

| | |
|---|---|
| alkyd denatured silicone resin (KR206 manufactured by Shin-Etsu Chemical Co., Ltd.) | 7 parts by weight |
| melamine resin (SUPERBECK-AMINE JB-820 manufactured by Dainippon Ink and Chemicals Inc.) | 3 parts by weight |
| paratoluene sulfonic acid | 0.06 parts by weight |
| methylethyl ketone | 20 parts by weight |

After the heat-resistant treating layer 15 was made by the resin liquid having the above-described composition, on the surface opposing to the surface in contact with the thermal print head 4, there was coated a resin liquid having the following composition to thereby form the ink layer 13 of thermal transfer property, thus an ink ribbon for sublimation transfer recording of this example being formed.

| | |
|---|---|
| cellulose acetate (L-70 manufactured by Daicel Ltd.) | 5 parts by weight |
| dispersion dye (SUMIPLAST RED FB manufactured by Sumitomo Chemical Co., Ltd.) | 5 parts by weight |
| fine powder of silica (AEROSIL R972 manufactured by Nippon Aerosil Co., Ltd.) | 2 parts by weight |
| methylethyl ketone | 80 parts by weight |

By using the gravure coater, the above resin liquid was printed through a printing plate having a depth of 45 μm and 185 lines/inch.

When this ink ribbon for sublimation transfer recording was used and then the printing test was carried out, a clear picture image having no scattering in printing density and which is free of a so-called sticking was obtained stably. After 1000 prints were obtained successively, the head element 4a and the nearby portion thereof were observed by a microscope. In this case, no deposition of the resin was discovered.

EXAMPLE 3

The ink ribbon 11 for sublimation transfer recording which was formed in the above-described Example 2 was manufactured. Then, on the upper surface of the heat-resistant treating layer 15, there was coated a resin liquid having the following composition available for the purpose of lowering the friction coefficient upon transportation by using a gravure coater through a printing plate having a depth of 20 μm and 200 lines/inch. This product was placed at a temperature of 130° C. for 5 minutes and then cured to form the lubricant layer 35 (see FIG. 5), thus an ink ribbon for sublimation transfer recording of this example being produced.

| | |
|---|---|
| silicone rubber of releasing property (KS841 manufactured by Shin-Etsu Chemical Co., Ltd.) | 9.9 parts by weight |
| catalyzer (CAT-PL-7 manufactured by Shin-Etsu Chemical Co., Ltd.) | 0.1 parts by weight |
| toluene | 90 parts by weight |

When this ink ribbon for sublimation transfer recording was used to carry out the printing test, a clear picture image having no scattering in the printing density and which was free of the sticking and so on was stably obtained. After 1000 prints were made continuously, the head element 4a and the nearby portion thereof were observed by the microscope. In this case, no deposition of resin was discovered therefrom.

EXAMPLE 4

The base material 14 was formed by the polyester film having the thickness of 8 μm. Then, on one surface of this plastic base material 14, there was coated a resin liquid having the following composition by a pipe coater such that the heat-resistant treating layer 15 may have the thickness of 5 μm after being dried. Thereafter, it was heated at a temperature of 130° C. for an hour and then cured.

| | |
|---|---|
| epoxy denatured silicone resin (ES1002T manufactured by Shin-Etsu Chemical Co., Ltd.) | 10 parts by weight |
| 2-methylimidasol (2MZ manufactured by Shikoku Chemicals Corp.) | 0.7 parts by weight |
| toluene | 20 parts by weight |

After the heat-resistant treating layer 15 was formed by the resin liquid having the above-described composition, on the surface opposing to the surface in contact with the thermal print head 4, there was coated a resin liquid having the following composition, thus a thermal transfer ink layer 13 being made.

| | |
|---|---|
| cellulose acetate (L-70 manufactured by Daicel Ltd.) | 5 parts by weight |
| dispersion dye (SUMIPLAST RED FB manufactured by Sumitomo Chemical Co., Ltd.) | 5 parts by weight |
| fine powder of silica (AEROSIL R972 manufactured by Nippon Aerosil Co., Ltd.) | 2 parts by weight |
| methylethyl ketone | 88 parts by weight |

By using the gravure coater, the resin liquid was printed through a printing plate having a depth of 45 μm and 185 lines/inch and thus the ink ribbon for sublimation transfer recording was formed.

When this ink ribbon for sublimation transfer recording was used to carry out the printing test, a clear picture image having no scattering in the printing density and which was free of the sticking and so on was stably obtained. After 1000 prints were made continuously, the head element 4a and the nearby portion thereof were observed by the microscope. In this case, no deposition of resin was discovered therefrom.

EXAMPLE 5

The base material 14 was formed by the polyester film having the thickness of 6 μm. On one surface of the base material 14, there was coated a resin liquid having the following composition by a pipe coater so that the heat-resistant treating layer 15 might have the thickness of 6 μm after being dried. Thereafter, it was heated at a temperature of 130° C. for an hour and then cured.

| | |
|---|---|
| epoxy denatured silicone resin (ES1002T manufactured by Shin-Etsu Chemical Co., Ltd.) | 8 parts by weight |
| bisphenol A type epoxy resin (EPICOAT 1004 manufactured by Shell Kagaku Kabushiki Kaisha) | 2 parts by weight |
| undecylimidazole ($C_{11}Z$ manufactured by Shikoku Chemicals Corp.) | 0.7 parts by weight |
| toluene | 20 parts by weight |

After the heat-resistant treating layer 15 was formed by the resin liquid having the above-described composition, on the surface opposing to the surface in contact with the thermal print head, there was coated a resin liquid of the following composition, thus the ink layer 13 having the thermal transfer property being formed.

| | |
|---|---|
| cellulose acetate (L-70 manufactured by Daicel Ltd.) | 5 parts by weight |
| dispersion dye (SUMIPLAST REB FB manufactured by Sumitomo Chemical Co., Ltd.) | 5 parts by weight |
| fine powder of silica (AEROSIL R972 manufactured by Nippon Aerosil Co., Ltd.) | 2 parts by weight |
| methylethyl ketone | 88 parts by weight |

By using the gravure coater, this coating composition was coated through a printing plate having a depth of 45 μm and 185 lines/inch and thus the ink ribbon for sublimation transfer recording of this example was formed.

When the ink ribbon for sublimation transfer recording of this example was used to carry out the printing test, a clear picture image having no scattering in the printing density and which was free of the sticking and so on was stably obtained. After 1000 prints were made continuously, when the head element 4*a* and the nearby portion thereof were observed by the microscope, no deposition of resin was discovered therefrom.

Next, to confirm the effects of Example 2, Example 3, Example 4 and Example 5, Comparative example 1 will be described.

Comparative example 1

On one surface of a condenser paper (H-14 manufactured by Honshu Paper Co., Ltd.) having a thickness of 14 μm used as a base material, there was coated a thermal transfer ink layer having the following composition by using the gravure coater so as to have the thickness of 1 μm after being dried, thus the ink ribbon for thermal transfer recording of this comparative example being formed.

| | |
|---|---|
| cellulose acetate (L-70 manufactured by Daicel Ltd.) | 5 parts by weight |
| dispersion dye (SUMIPLAST RED FB manufactured by Sumitomo Chemical Co., Ltd.) | 5 parts by weight |
| fine powder of.silica (AEROSIL R972 manufactured by Nippon Aerosil Co., Ltd.) | 2 parts by weight |

-continued

| | |
|---|---|
| methylethyl ketone | 88 parts by weight |

After the ink ribbon of this comparative example was used and 1000 prints were continuously printed similarly to the above-described examples, the results were observed by the microscope. In this case, it was confirmed that the resin component contained in the condenser paper which was used as the base material was deposited to the thermal print head 4.

Figure 9:
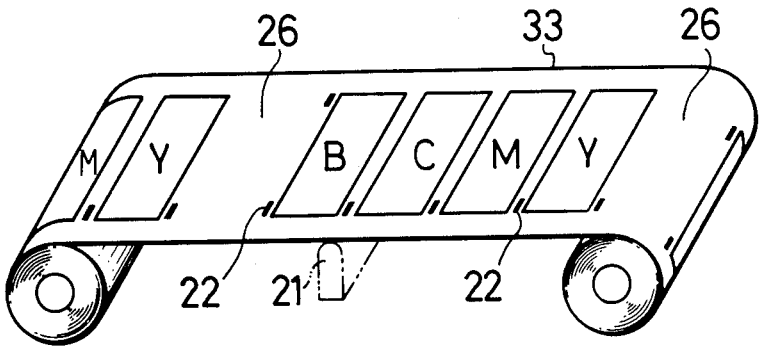
FIGS. 9 to 11 are respectively perspective views showing other embodiments of the ink ribbon according to the present invention.

FIG. 9 illustrates a further embodiment of this invention.

In the embodiment in FIG. 6, for the purpose of preventing the coagulated material of the sublimation dye deposited on the printing paper 17 from losing a color and the like purpose, after the dyes of 4 colors were transferred, the cover film layer 10 was formed on the printing paper 17. However, in practice, it is cumbersome to form such protecting layer and in addition, when the cover film layer 10 is formed on the thin printing paper 17, a deformation such as a curl and so on will frequently be caused on the printing paper 17. This embodiment is to remove such defects.

Figure 10:
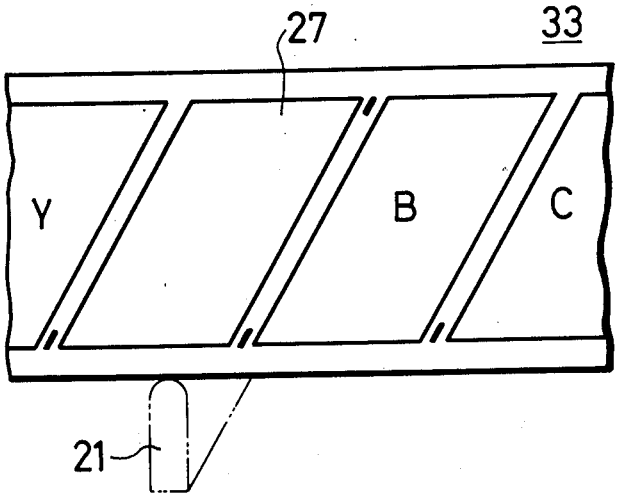
Figure 12:
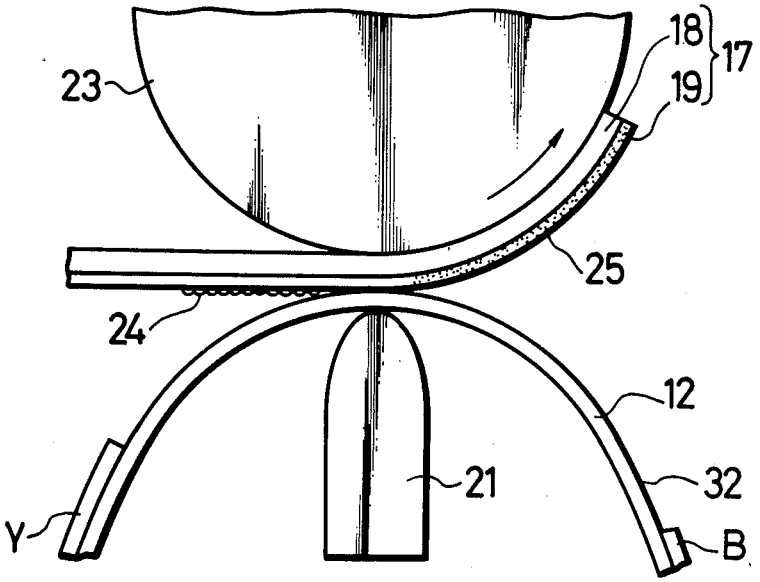
FIG. 12 is a side view showing the ink ribbon of the above embodiments while in use.

In this embodiment, as shown in FIG. 9, next to the last coating layer of the respective color coating layers of sublimation dyes necessary for forming one picture image, or the coating layer B of the black color ink in this embodiment, there is formed a portion 26 of an area equal to or larger than a picture image and in which no coating layer is formed to thereby form an ink ribbon 33. After the picture image of the coating layers Y, M, C and B of 4 colors is formed on the printing paper 17, as shown in FIG. 12, the portion 26 without the coating layer is successively urged against the printing paper 17 and the picture image is once again heated from the back of the ink ribbon by the thermal print head 21. By virtue of such re-heating, the coloring inherent to the dye can be developed and a coagulated material 24 of dye deposited on the printing paper 17 can be diffused well into the dye diffusing layer 19. The heat amount of the thermal print head 21 for such re-heating of the picture image is free from the restriction put by the signal that forms the picture image and becomes an electric power required by the whole of the resistor elements of the thermal print head 21 to diffuse the dye well. Such re-heating can be carried out a plurality of times by using the same portion 26 in which no coating layer is formed and this ensures that the dye can be fixed more completely. Further, as shown in FIG. 10, if a thin film 27 which is hard to be diffused with the dye is formed on the portion 26 in which no coating layer is formed, when the picture image is heated once again, the dye can be prevented from being dropped from the picture image and this enables the dye to be thermally fixed effectively. The thin film 27 which is hard to be diffused with the dye can be obtained by coating casein, coating and curing a curable heat-resistant resin such as polyimide resin, silicone resin, melamine resin and so on, metal plating, metal thin film treatment and so on.

According to this ink ribbon 33, the picture image can be fixed without using the protecting layer. Since the protecting layer is not used, the printing paper can be protected from the deformation such as curl and so on.

Figure 11:
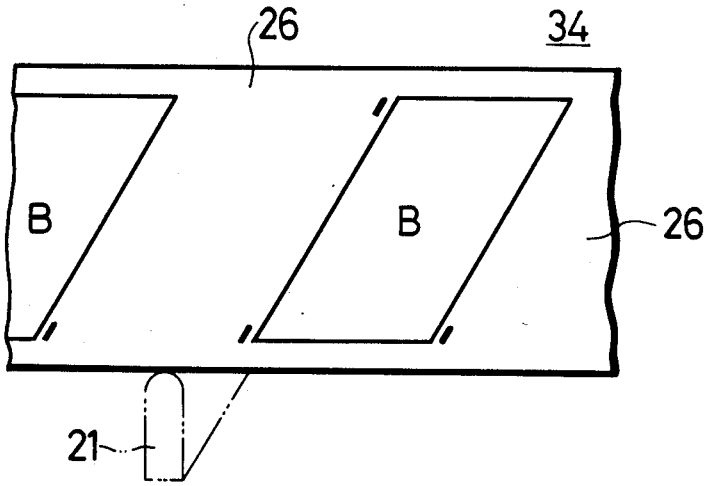

FIG. 11 illustrates an embodiment in which the above-described structure is applied to an ink ribbon 34 for a black and white picture image. In this case, next to the black color coating layer B, there is formed the portion 26 having no coating layer.

As set forth above, according to the present invention, as the film base of the ink ribbon for sublimation transfer type hard copy, there is used the heat-resistant plastic film base or the plastic film base having formed thereon the heat-resistant treating layer. Consequently, such film base contains no water component and produces no bubble unlike the prior art so that the bubble spot is removed from the picture image completely. Further, unlike the prior art condenser paper, the film base can be prevented from being shrunk largely by the heating and the film base is rather swollen a little so that no wrinkle is produced between the film base and the printing paper. Thus, the quality of the transferred picture image can be improved.

We claim:

1. An ink ribbon for sublimation transfer type hard copy in which such ink ribbon containing a sublimation dye and a printing paper are in contact with each other and a picture image is formed on said printing paper by a selective heat treatment, characterized in that said ribbon includes a substrate of polyethylene terephthalate substantially free of water content, an ink layer formed on the surface of said substrate, said ink layer being formed of a binder and a dye sublimable upon heating, a heat-resistant coating layer formed on another surface of said substrate, and a lubricating layer on said heat-resistant coating layer.

2. An ink ribbon for sublimation transfer type hard copy according to claim 1, characterized in that a cover film layer made of a transparent resin layer which is to be melt bonded and transferred on a printed printing paper is further formed on said film base.

3. An ink ribbon for sublimation transfer type hard copy according to claim 1, characterized in that coating regions of yellow, magenta and cyan dyes are formed on said base film in turn in the longitudinal direction of said base.

4. An ink ribbon for sublimation transfer type hard copy according to claim 1, characterized in that dye coating regions of yellow, magenta, cyan and black are formed on said base in turn in the longitudinal direction of said base.

5. An ink ribbon for sublimation transfer type hard copy according to claim 1, characterized in that dye coating regions of yellow, magenta and cyan and a cover film region are formed on said base in turn in the longitudinal direction of said base.

6. An ink ribbon for sublimation transfer type hard copy according to claim 1, characterized in that dye coating regions of yellow, magenta, cyan and black and a cover film region are formed on said base in turn in the longitudinal direction of said base.

7. An ink ribbon according to claim 1 wherein said heat-resistant coating layer is composed of a resin having no melting point.

8. An ink ribbon according to claim 1 wherein said heat-resistant coating layer is made of a heat-curable resin.

9. An ink ribbon according to claim 1 wherein said lubricating layer is formed of a silicone resin.

10. An ink ribbon for sublimation transfer type hard copy in which such ink ribbon containing a sublimation dye and a printing paper are in contact with each other and a picture image is formed on said printing paper by a selective heat treatment, characterized in that said ribbon includes a substrate of polyethylene terephthalate substantially free of water content, an ink layer formed on the surface of said substrate, said ink layer being formed of a binder and a dye sublimable upon heating and a heat-resistant coating layer formed on another surface of said substrate, said heat-resistant coating layer being formed by curing a denatured silicone resin denatured by a resin which is selected from an alkyd resin, urethane resin, epoxy resin or acrylic resin.

* * * * *